US008668533B2

(12) United States Patent
Rolla

(10) Patent No.: US 8,668,533 B2
(45) Date of Patent: Mar. 11, 2014

(54) WATERJET PROPULSION SYSTEM AND METHOD FOR A MARINE VEHICLE

(75) Inventor: Philip Rolla, Bruzella (CH)

(73) Assignee: Twin Disc, Inc., Racine, WI (US)

( * ) Notice: Subject to any disclaimer, the term of this patent is extended or adjusted under 35 U.S.C. 154(b) by 216 days.

(21) Appl. No.: 13/179,113

(22) Filed: Jul. 8, 2011

(65) Prior Publication Data

US 2011/0275254 A1 Nov. 10, 2011

Related U.S. Application Data

(63) Continuation-in-part of application No. 12/478,329, filed on Jun. 4, 2009, now Pat. No. 8,187,046.

(51) Int. Cl.
*B63H 21/22* (2006.01)

(52) U.S. Cl.
USPC ..... 440/1; 440/38; 440/40

(58) Field of Classification Search
USPC ..... 440/1, 38, 40, 75
See application file for complete search history.

(56) References Cited

U.S. PATENT DOCUMENTS

| | | | | |
|---|---|---|---|---|
| 3,985,094 | A | 10/1976 | Stricker | |
| 5,634,831 | A | 6/1997 | Davies et al. | |
| 5,752,862 | A | 5/1998 | Mohler et al. | |
| 5,800,222 | A * | 9/1998 | Nanami | 440/38 |
| 5,967,864 | A * | 10/1999 | Koyano et al. | 440/38 |
| 6,022,250 | A * | 2/2000 | Futaki et al. | 440/38 |
| 6,193,570 | B1 * | 2/2001 | Ishigaki | 440/38 |
| 6,524,068 | B2 * | 2/2003 | Carter, Jr. | 416/1 |
| 6,626,713 | B2 * | 9/2003 | Bruce | 440/38 |
| 7,442,103 | B1 | 10/2008 | Carr | |
| 2005/0159052 | A1 | 7/2005 | Borrett | |

OTHER PUBLICATIONS

European Search Report and the Written Opinion of the International Searching Authority; European Patent Application No. PCT/US2012/045724; Filed Jul. 6, 2012; (9 Pages).

* cited by examiner

*Primary Examiner* — Lars A Olson
(74) *Attorney, Agent, or Firm* — Boyle Fredrickson, S.C.

(57) ABSTRACT

A waterjet based propulsion system and method that utilizes more than one waterjet outlet port and controls the selective application of power to the waterjets with a splitter gearbox thereby improving the efficiency of the marine craft at low and high speeds.

16 Claims, 13 Drawing Sheets

WATERJET PROPULSION SYSTEM AND METHOD FOR A MARINE VEHICLE

CROSS-REFERENCE TO RELATED APPLICATION

This application is a continuation-in-part of U.S. Non-Provisional patent application Ser. No. 12/478,329, filed on Jun. 4, 2009, entitled MARINE POWER SPLITTING GEARBOX the entirety of which is expressly incorporated by reference herein.

BACKGROUND OF THE INVENTION

1. Field of the Invention

The present invention relates generally to marine propulsion systems and more specifically to marine waterjet propulsion systems having two or more waterjets.

2. Discussion of the Related Art

Waterjet propulsion whereby a stream of water is hydraulically pumped from a nozzle driven by a pump is becoming increasingly more popular with marine craft manufacturers and their customers. Typically a water inlet port is located upstream of the pump, the inlet port being positioned beneath the water line. The water enters through the inlet port and is directed towards the pump in the inlet duct. The water is then accelerated by the pump out the exhaust outlet port or nozzle thus propelling the watercraft through the water. In addition, there are waterjet propulsion systems that utilize two or more waterjets. For example, U.S. Pat. No. 6,626,713 discloses a water intake and transmission system for simultaneously driving dual waterjet units of a marine vehicle.

A conventional single waterjet system is designed to be able to produce the thrust required to overcome the boat drag at the maximum boat design speed. However, at lower speeds, due to reduced pump power and/or increased boat loads, the propulsive efficiency for a single waterjet is reduced and thus not optimally efficient. In addition, dual waterjet systems such as the system set forth in the aforementioned U.S. Pat. No. 6,626,713 patent will exhibit inefficiencies relative to thrust versus drag at various watercraft speeds when the size of the exhaust outlet ports is fixed and mutually engaged. In general, single or dual waterjet systems with a given cross-sectional diameter or a set of combined diameters are less efficient at low speeds and high drag conditions, the pump being designed to reach its maximum efficiency at a certain watercraft velocity drag ratio.

In light of numerous environmental and cost concerns, efficiency is a major concern with respect to propelling marine vehicles. As well, speed is an important consideration, especially for marine racing vehicles and marine vehicles that are used in pursuit. In addition the dual operation of both waterjets provides more power with a lesser horsepower engine realizing weight and cost reductions and further efficiency gains.

Some efforts have been made to provide multiple waterjet propelled vehicles that are optimized for speed and efficiency, but there is no known history of a marine splitter gearbox which has a single power input and two or more waterjet outputs wherein the waterjets may be independently engaged and may differ in their outlet ports diameters or total effective diameter.

Because the current marine waterjet propulsion systems fail to provide a solution to the problems of lower efficiency and the resulting higher fuel and pollution costs, what is needed then is a waterjet propulsion device for a marine vehicle that is more efficient—at both high and low speeds.

SUMMARY OF THE INVENTION

The present invention is a waterjet based marine propulsion system that provides a device for transmitting power from a single power input to at least two waterjet propulsion devices.

This device utilizes at least two marine waterjets powered by one power source, and allows the uncoupling of power to either one of the waterjets while the marine craft is in operation. In addition, improved efficiencies can be achieved at higher speeds by reducing the exhaust outlet port's or ports' cross-sectional diameters. The present embodiments have solved a significant efficiency problem of waterjet propulsion by discovering that the waterjet diameter required for low-medium speed and intermediate speed hump conditions requires approximately double the area that is needed for efficient high speed operation. By using a splitter gearbox device the single power source may power, for example, two waterjets up to a certain speed and resistance and then one jet will be decoupled (i.e., disengaged) from the power output of the gearbox while the narrower diameter high speed waterjet remains engaged. As a result the power source will then be applied to a single waterjet which will have optimum sizing for the high speed range of the craft thereby yielding a significant gain in propulsive efficiency. The disengaged waterjet may be allowed to fill with water and thus give very little or no resistance drag. Alternatively, there may be a gate (i.e., flap) that closes the water inlet to the unused waterjet thereby further reducing resistance drag. The power source for the system may be a diesel engine, gas turbine or, and generally most desirable, an HTS electric motor which gives maximum torque over a very large RPM range. The splitter gearbox may also provide reduction or multiplication in RPM from the input thereby giving optimum operating RPM to the waterjets.

The waterjet propulsion system of the present invention may be utilized for very slender multi-hull vessels which require a minimum waterjet diameter. In these cases the waterjets outlets may be installed vertically (i.e. stacked or piggyback) and the splitter gearbox outputs may also be vertically aligned to match this configuration thus giving minimum installation width. On a very slender hull the placement of the waterjet intakes may be on the lower vertical sides of the hull substantially below the waterline, rather then on the bottom of the hull. In special cases, such as for a landing craft, this would allow the craft to beach or work in shallow water without the waterjet intake injecting debris into the impeller. There are many possible variations of waterjet mounting and inlet positioning within the scope of the invention's claims.

The marine splitter gearbox for waterjets will overcome a major problem of waterjets and that is for a wide speed and resistance-operating range the optimum impeller size is double in area for low-medium speeds then that needed for maximum propulsive efficiency at high speeds. By decoupling one of the jets when the craft moves into the high speed range propulsive efficiency is optimized.

In sum, though the state of the art in this area achieves some degree of optimization, there is no known history of a marine splitter gearbox which has a single power input and two or more waterjet outputs wherein the waterjets may be independently engaged and may differ in their outlet ports diameters or total effective diameter. With the present preferred embodiments, the degree of propulsive efficiency gain will depend on the differential between hump speed (e.g., planning speed)

and top speed on the craft. The more the differential between the two, the more the preferred embodiments offer efficiency gains which can easily be 25% if the top speed potential is high enough (10 and 25% can be expected in most high speed applications).

According to one aspect of the invention, a drive for a marine craft includes a power source, a gearbox, a first waterjet propulsion unit with a first nozzle section having a first cross-sectional diameter, and as a second waterjet propulsion unit with a second nozzle section having a second cross-sectional diameter. The drive also includes a first waterjet engagement apparatus that transmits power from the gearbox to the first waterjet propulsion unit, and a second waterjet engagement apparatus that transmits power from the gearbox to the second waterjet propulsion unit). At least one of the first waterjet engagement apparatus and/or the second waterjet engagement apparatus is engaged to provide propulsion to the marine craft.

In another aspect of this embodiment, the cross-sectional diameter relationship between the two waterjet propulsion units is one of the following: 1) the first cross-sectional diameter is less than the second cross-sectional diameter, 2) the first cross-sectional diameter is substantially equal to the second cross-sectional diameter, and 3) the first cross-sectional diameter is greater than the second cross-sectional diameter.

According to another aspect of this embodiment, the first waterjet propulsion unit has a first pump, a first impeller in communication with the first waterjet engagement apparatus (with the first nozzle section having the first cross-sectional diameter), and a first intake section. Similarly the second waterjet propulsion unit has a second pump, a second impeller in communication with the first waterjet engagement apparatus (with the second nozzle section having the second cross-sectional diameter), and a second intake section. As well, the first nozzle section may be on a transom of the marine craft, and the second nozzle section may be arranged substantially directly above the first nozzle section, also on the transom of the marine craft.

In a further aspect of this embodiment, the drive has at least one inlet port wherein the first intake section and the second intake section are in communication with the at least one inlet port.

In yet another aspect of this embodiment, at least one gate is configured for controlling a flow of water into at least one of the first intake section and the second intake section. According to another aspect of this embodiment, a transmission element may be a 2-speed gearbox which is connected to the power source and transmits power to the gearbox. As well, the first waterjet engagement apparatus may have a 2-speed gearbox.

According to another aspect of this embodiment, the drive may have a user operable control to selectively engage the first waterjet propulsion unit and/or to selectively engage the second waterjet propulsion unit. The drive may also have an automatic control to selectively engage at least one of the first waterjet propulsion unit and the second waterjet propulsion unit dependent on marine craft speed and/or marine craft resistance.

According to yet another aspect of this embodiment, the drive may have an automatic control to selectively engage at least one of the first waterjet propulsion unit and the second waterjet propulsion unit dependent on marine craft actual direction, commanded steering direction, and/or commanded reversing direction.

In a further aspect of this embodiment, the drive may have a steering deflector to steer the marine craft by deflecting water flow ejected from the first nozzle section and a second water flow ejected from the second nozzle section.

According to yet another aspect of this embodiment, the drive may have at least one reversing deflector to reverse the marine craft by deflecting water flow ejected from the first nozzle section and/or a second water flow ejected from the second nozzle section.

In a further aspect of this embodiment, the drive may have a first steering deflector to steer the marine craft by deflecting a water flow ejected from the first nozzle section and a second steering deflector to steer the marine craft by deflecting a second water flow ejected from the second nozzle section.

According to another embodiment, the drive includes a marine craft, a power source, one or more splitter gearboxes, one or more transmission elements connected to the power source to transmit power to the one or more splitter gearboxes, one or more pairs of waterjet propulsion units wherein each pair comprises a first waterjet propulsion unit and a second waterjet propulsion unit. The first waterjet propulsion unit includes a first pump section, a first waterjet engagement apparatus (for transmitting power from at least one of the splitter gearboxes to the first waterjet propulsion unit), a first impeller in communication with the first waterjet engagement apparatus, a first nozzle section having a first cross-sectional diameter, and a first intake section. As well, a second waterjet propulsion unit has a second pump section, a second waterjet engagement apparatus (for transmitting power from at least one of the splitter gearboxes to the first waterjet propulsion unit), a second impeller in communication with the first waterjet engagement apparatus, a second nozzle section having a first cross-sectional diameter, and a second intake section.

According to yet another embodiment, a method of driving a marine craft has the steps of: 1) providing power from a power source, 2) transmitting power from the power source to at least one splitter gearbox, 3) communicating power from at least one splitter gearbox to two or more waterjet propulsion units (wherein the waterjet outlets for a given pair of waterjet propulsion units are vertically arranged), and 4) engaging one or more selected pump sections of the waterjet propulsion units so as to provide propulsive force from water exiting at least one waterjet propulsion unit nozzle outlet sections so as to drive the marine craft. The selected pump section(s) are engaged based marine craft speed, marine craft resistance, user selected speed, user selected gear, high speed mode, low speed mode, and/or one or more nozzle outlet section configurations.

According to another embodiment, the drive includes a power source, a gearbox, a plurality of waterjet propulsion units (each having a nozzle section, a cross-sectional diameter, and a waterjet engagement apparatus configured for transmitting power from the gearbox to the waterjet propulsion unit) wherein at least one of the waterjet engagement apparatuses are engaged, thus providing propulsion to the marine craft. In a further aspect of this embodiment the drive also includes a control to selectively engage one or more of the waterjet propulsion units dependent upon one or more of a manual shift setting, a manual speed setting, a marine craft actual direction, a commanded steering direction, and a commanded reversing direction.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
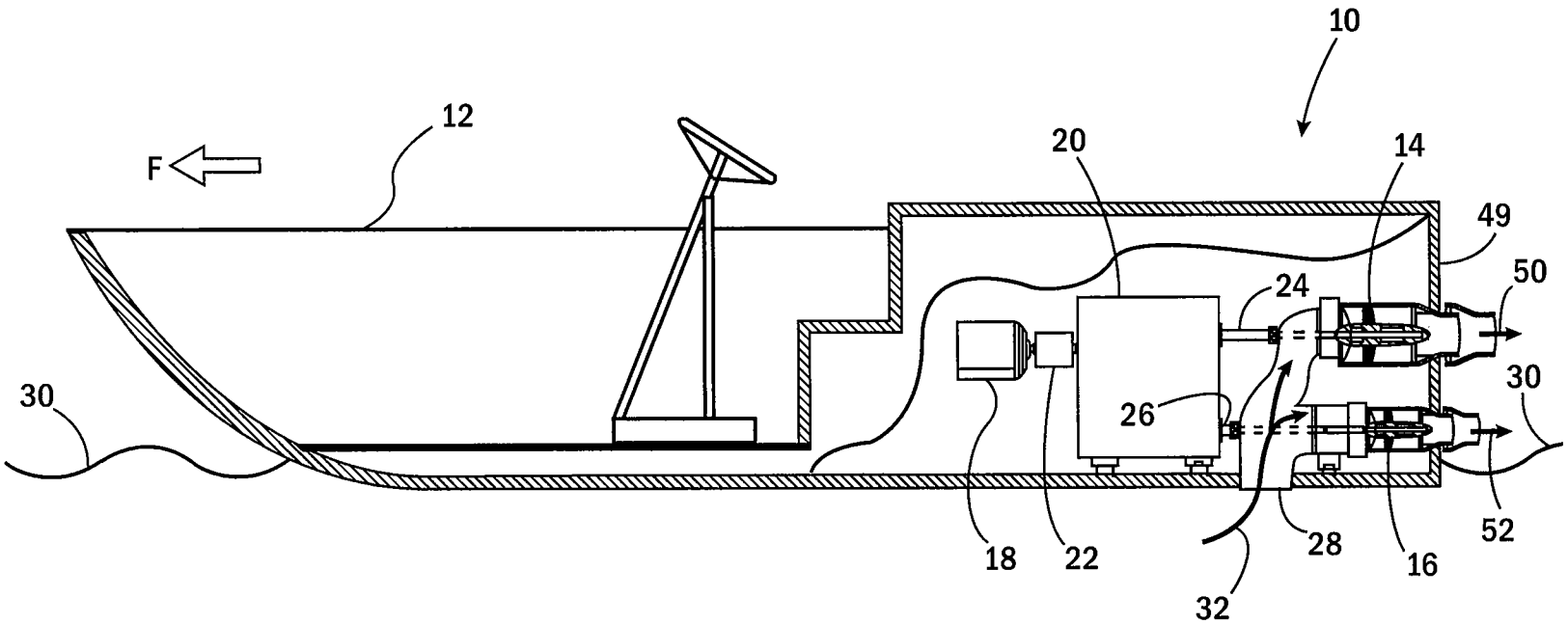
FIG. 1 is a side cutaway view of a marine craft having a waterjet propulsion system in accordance with a preferred embodiment.

With reference now to the drawings, and particularly to FIG. 1, there is shown a cutaway side view of an aft portion of a marine vessel 12 that shows an embodiment of the marine propulsion system 10 of the preferred embodiment.

Marine propulsion system 10 utilizes two waterjet propulsion units 14, 16 and a power source, shown as an electric motor 18 and a gearbox 20. The gearbox 20 may be a splitter gearbox having an input that is a transmission element 22 connected to power source 18 to transmit power to gearbox 20. In addition gearbox 20 has two waterjet engagement apparatuses shown as shafts 24, 26. Gearbox 20 may transmit power to either or both waterjet propulsion units 14, 16 via shafts 24, 26. Transmission element 22 may be a connecting shaft (now shown), or may comprise transmission components, such as a 2-speed gearbox, for controlling the power transmitted to gearbox 20.

Figure 2:
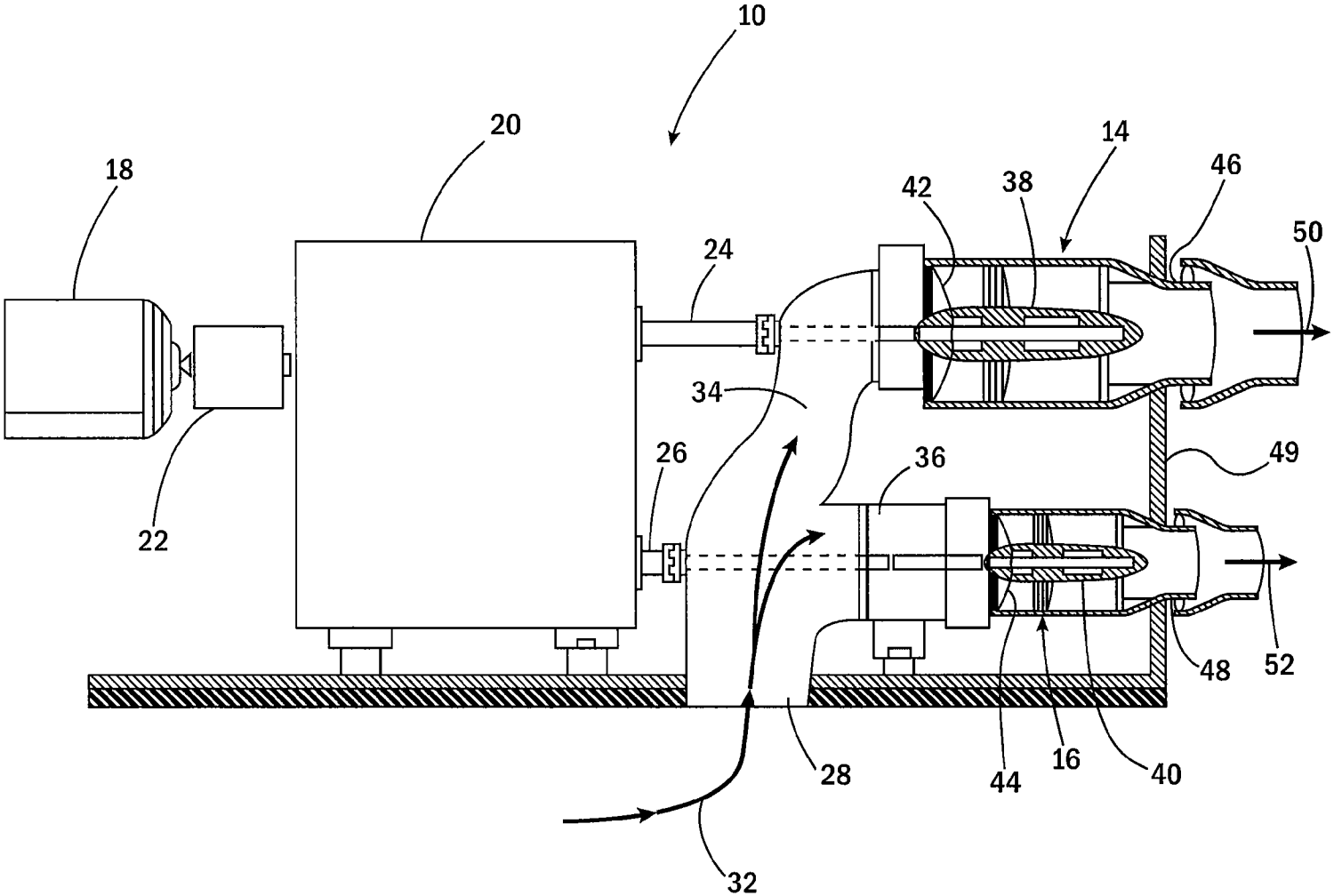
FIG. 2 is a side cross section view of the waterjet propulsion system showing a portion of the marine vehicle.

Continuing with FIG. 1 but also referring to FIG. 2, marine propulsion system 10 may move marine craft 12 in the forward direction as indicated by arrow F when either or both of the waterjets 14, 16 are engaged by splitter gearbox 20. This is accomplished when either or both of the shafts 24, 26 are rotated by gearbox 20. A water inlet port 28 (typically located upstream of the waterjets 14, 16) is positioned beneath the waterline 30 and serves as an intake for water which is indicated by arrows 32. Water 32 enters through inlet port 28 and is directed towards the waterjet intake sections shown as ducts 34, 36. Water 32 is then accelerated by one or both of the first and second waterjet pumps 38, 40 utilizing the corresponding first and/or second pump impellers 42, 44. The water is ejected by one or both of the first and second nozzle sections (i.e. outlets) 46, 48 forming the propulsive ejected water flow shown by arrows 50, 52 thus propelling the watercraft 12 in direction F. The nozzle sections 46, 48 may be vertically mounted on a transom 49. In other embodiments, the inlet ports location and number lends itself to a plurality of configurations and may be varied as seen fit by the designer. For example, the low speed jet's inlet may be on the side of a slender hull to avoid debris ingestion in shallow waters. The intake in the hull bottom could be a single aperture for both jets or separate or even side mounted separate if employed in a very slender hull. Due to pump diameters, axial flow pumps may be preferably used. As well, mixed flow pumps may be used where otherwise they could not be considered because of their size. It is also possible to have an upper mixed flow pump and lower axial flow pump.

Figure 3:
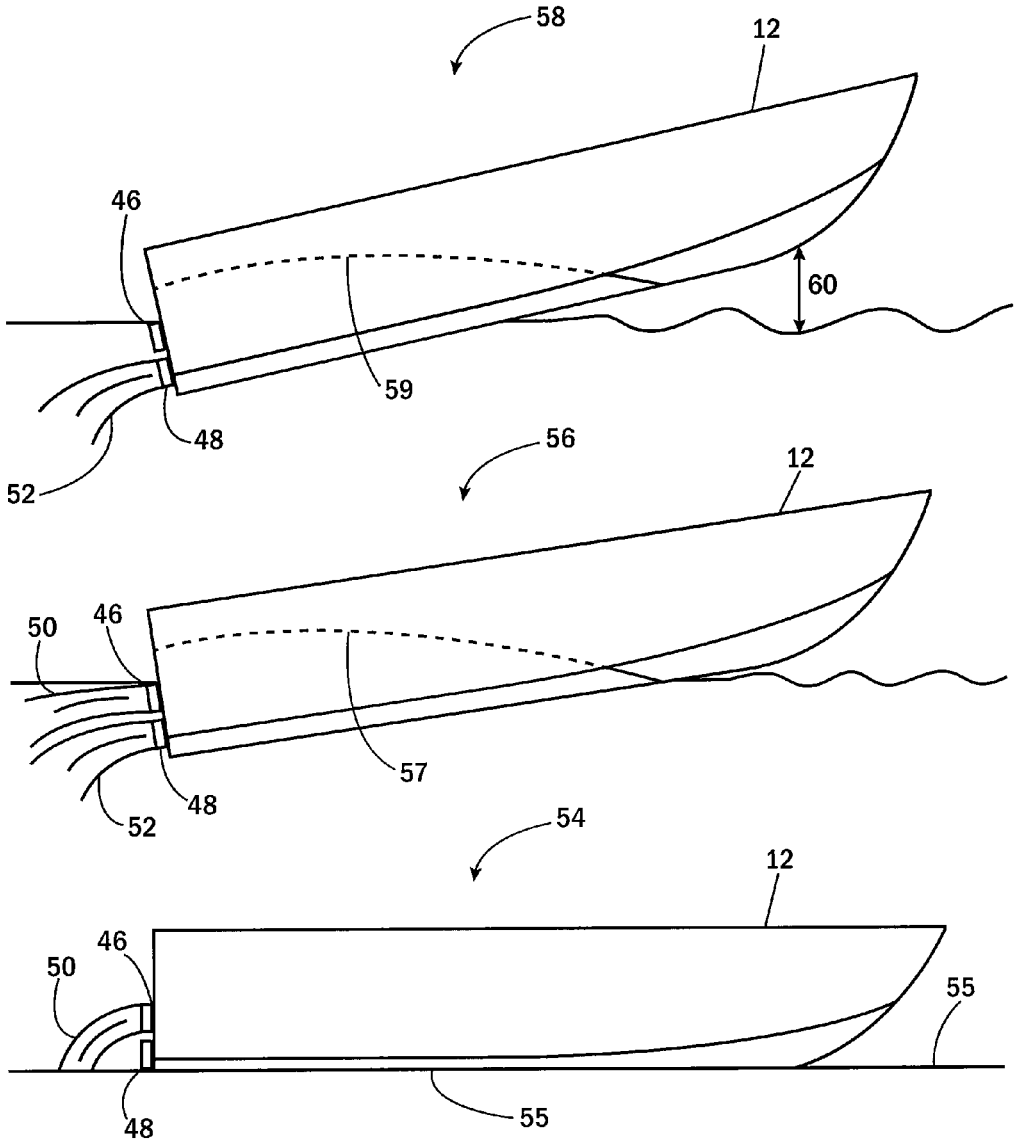
FIG. 3 is series of diagrams showing a marine craft operating at three different speeds and equipped with a waterjet propulsion system in accordance with the preferred embodiments.

Referring now to FIG. 3, a series of three diagrams show a marine craft 12 equipped with a propulsion system of the preferred embodiments, with the marine craft 12 moving forward at three differing speeds. At a low speed 54, the water surrounding the boat 55 is substantially flat. For such a low speed the upper nozzle section 46 having a wider cross-sectional diameter is engaged and ejecting water 50 to move the marine vessel 12 forward. At low speeds the propulsive efficiency may be improved by utilizing only the larger cross-sectional diameter outlet 46 to propel the marine craft 12. However, at an intermediate speed 56 the water surrounding the boat forms a substantial hump 57 creating maximum friction between the vessel 12 and the surrounding water 57. At this point the marine vehicle 12 requires substantially more power to get past the intermediate speed which produces the most drag on the boat 12. For such an intermediate speed both the wider upper nozzle 56 is engaged (ejecting water 50), and the narrower diameter lower nozzle 48 is engaged (ejecting water 52) while overcoming the hump 57. Thus, the combined power of engaging both nozzles 46, 48 provides more power at a higher propulsive efficiency (as explained in FIG. 5 below) and can thus more quickly and efficiently overcome the maximum drag from hump 57. At a high speed 58 a water hump 59 still creates drag, but the brow of the boat 12 is lifted a distance 60 thereby creating less overall drag on marine craft 12. For such a high speed only the lower nozzle section 48 having a narrower diameter is engaged ejecting water 52 to move the marine vessel 12 forward. At high speeds the propulsive efficiency is improved by utilizing only the smaller diameter outlet 48 to move the boat 12 forward (also explained in FIG. 5 below). Alternatively, both nozzles 46, 48 may be used at low speeds and intermediate speeds with the narrower diameter nozzle 48 used independently at high speeds. In yet another embodiment, the cross-sectional diameter relationship may be one wherein the outlet nozzles may be substantially the same diameter (not shown).

Figure 4:
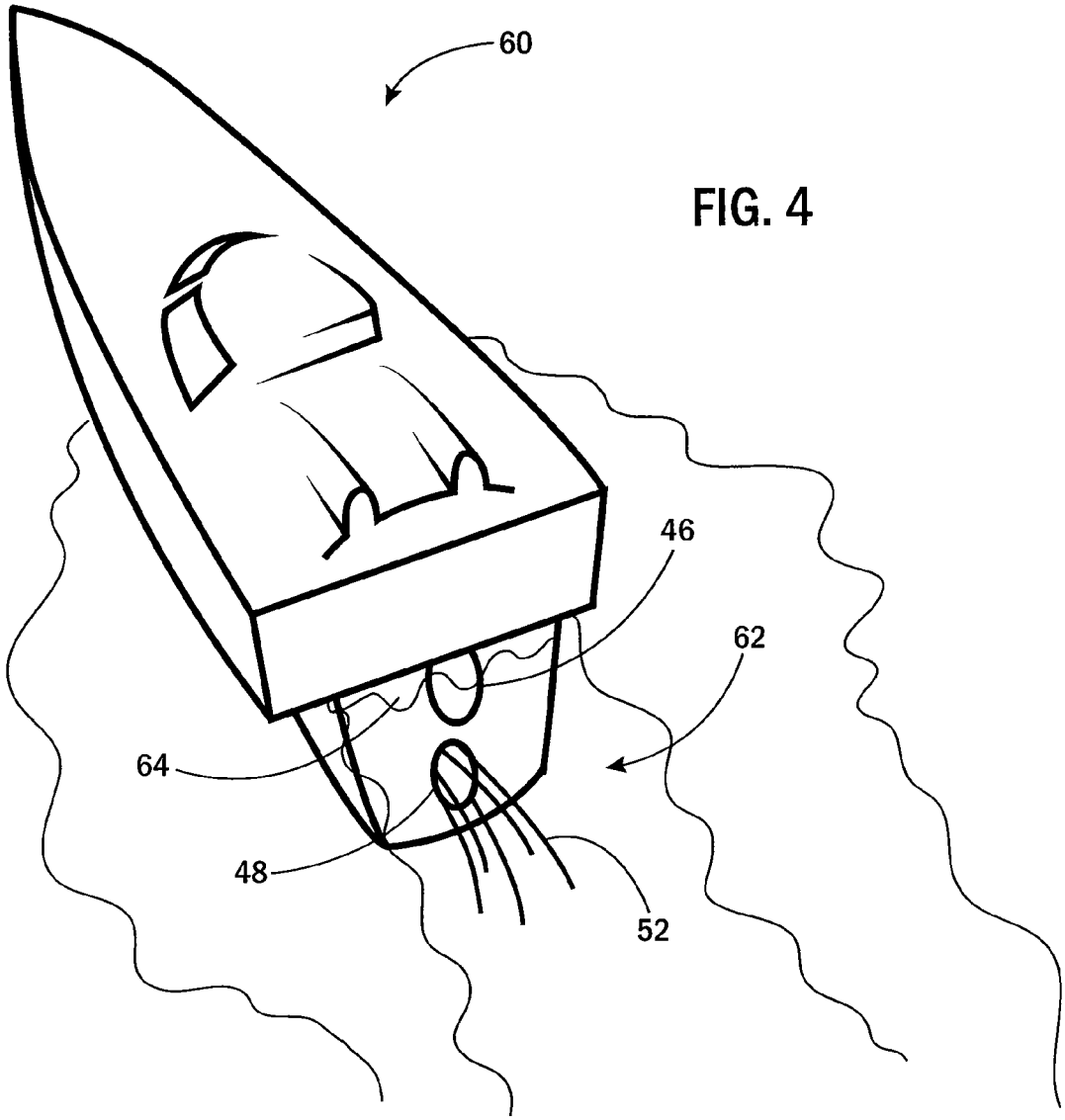
FIG. 4 is an isometric view of a marine racing craft equipped with a waterjet propulsion system in accordance with the present invention.

Turning now to FIG. 4, a marine craft such as a narrow-hulled speed boat 60 is equipped with a waterjet propulsion system 62 according to the preferred embodiments. The outlets 46, 48 are vertically arranged on the transom 64 of speed boat 60 while the inlet is on the bottom hull of the craft 60 (not shown). Alternatively, on a very slender hull the placement of the waterjet intake(s) may be on the lower vertical sides of the hull substantially below the waterline, rather then on the bottom of the hull. Speed boat 60 is shown travelling at a high speed with just the lower and narrower "high speed" waterjet outlet 46 engaged and ejecting water 52.

Continuing with FIG. 4, the waterjet propulsion system 62 may preferably be utilized for very slender multi-hull vessels which require a minimum waterjet diameter. In these cases the waterjets outlets 46, 48 may be installed vertically (i.e., stacked or piggyback) and the splitter gearbox outputs may also be vertically aligned to match this configuration (as shown in FIGS. 1-2). Vertical stacking allows a very slender mounting area and thus is a preferable configuration to use in very slender multi-hull marine crafts.

Figure 5:
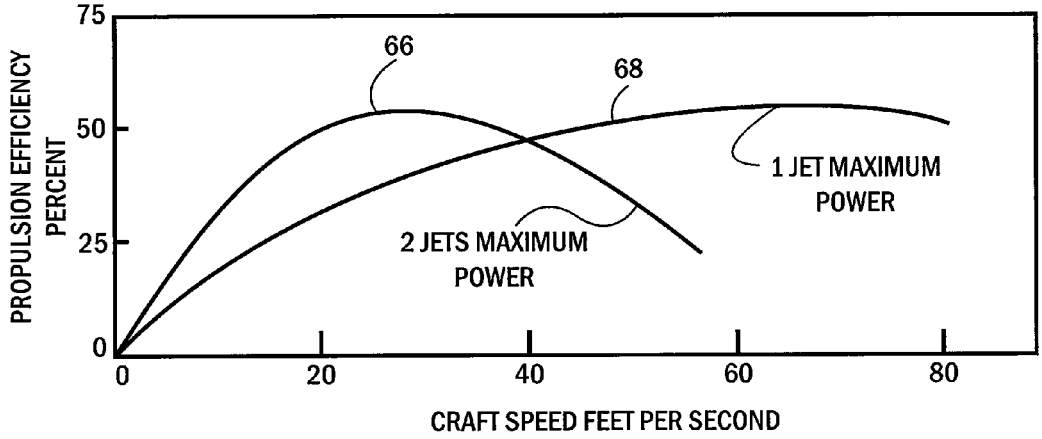
FIG. 5 is a chart illustrating propulsive efficiency percentages during single waterjet and dual waterjet maximum power settings.

FIG. 5 is a chart illustrating propulsive efficiency percentages during single waterjet and dual waterjet operation. Curve 66 indicates two waterjet operation and shows that the increased thrust available at the intermediate water vehicle speeds yields a maximum of propulsion efficiency wherein hump conditions must be overcome (e.g., at about 25 feet per second), as discussed above (FIG. 3). Notably, the single waterjet is more efficient at higher speeds as shown by curve 68 (which has a maximum propulsive efficiency at a velocity of about sixty (60) feet per second), while it is much less efficient in the lower speed high drag region as indicated. Thus to gain maximum propulsive efficiency from the available power source, the two waterjets may be engaged as shown by curve 66 in the high-drag low or intermediate speed ranges, while in the low-drag higher speed ranges a single waterjet is preferably engaged as shown by curve 68.

Figure 6:
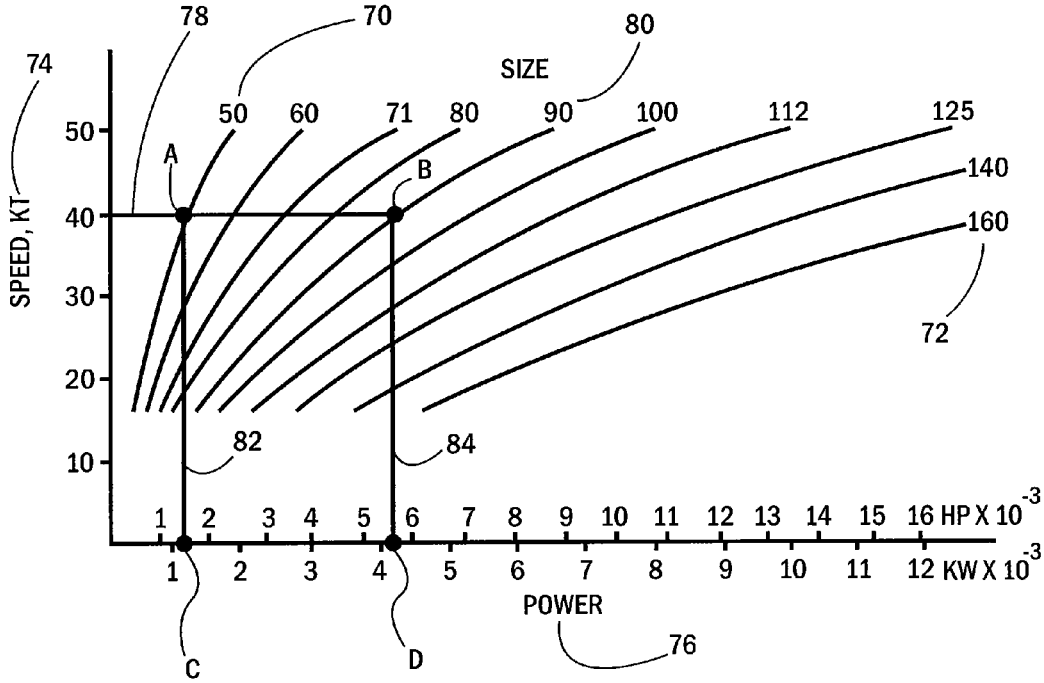
FIG. 6 is a chart illustrating speed versus power output for a range of differing diameter waterjets.

FIG. 6 is a waterjet pump selection chart showing a selection of curves for different pump inlet diameters in centimeters from fifty centimeters 70 to sixty three inches 72. The curves 70, 72, indicate how the particular diameter waterjet performs in terms of speed in knots 74 versus applied normalized power in HP and kW 76.[1] Waterjets with narrower diameter pumps such as fifty centimeters 70 realize higher speeds at lower power than waterjets with wider diameter pumps such as one hundred and sixty centimeters 72. For example, to reach a speed of 40 knots a line 78 can be drawn to intercept fifty centimeter curve 70 and ninety centimeter curve 80 at points A and B respectively. Lines 82, 84 are drawn to their horizontal intercept points C and D respectively indicating that the fifty centimeter waterjet requires only about 1.2 Watts compared to the ninety centimeter waterjet that requires about 4.2 Watts to propel the craft at 40 knots. Thus, during high speed single waterjet operation there may be a substantial gain in propulsive efficiency realized by utilizing a narrower diameter waterjet.

[1] FIG. 92. KaMeWa Preliminary Size Selection Chart, SNAME (Society of Naval Architects and Marine Engineers) published document no. 7405 in 1993, "Marine Waterjet Propulsion" by John Allison.

Figure 7:
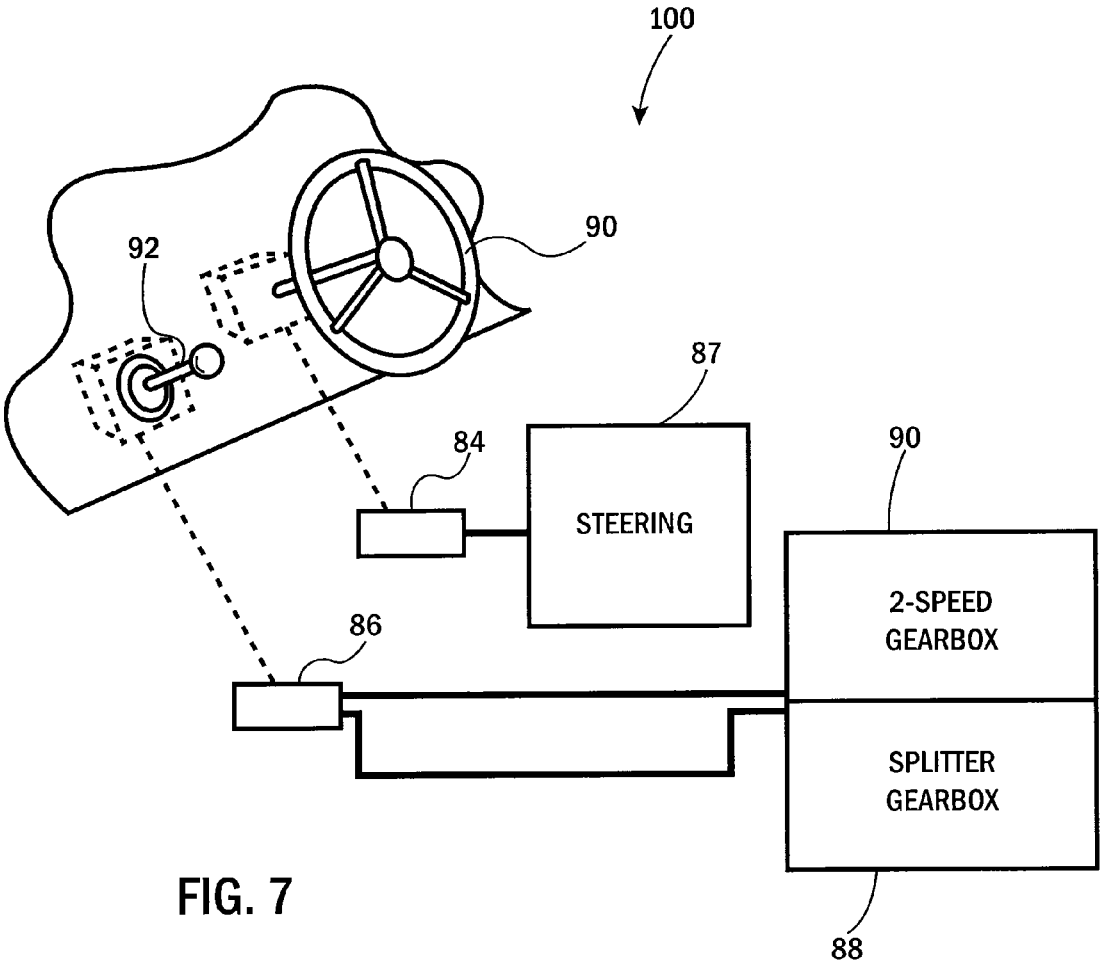
FIG. 7 is a schematic diagram showing steering and speed inputs controlling the waterjet propulsion system in accordance with the preferred embodiments.

Referring primarily to FIG. 7, the waterjet propulsion system 100 (shown largely as a block diagram) may have user controls such as steering control 90 and accelerator control 92. There may also be a corresponding electronic subsystem for steering 84 in communication with a mechanical waterjet steering system 87. In addition, there may be corresponding subsystem for controlling the speed 86 in communication with the splitter gearbox 88 and two-speed gearbox 90. These control subsystems will be explained in detail below.

Figure 8:
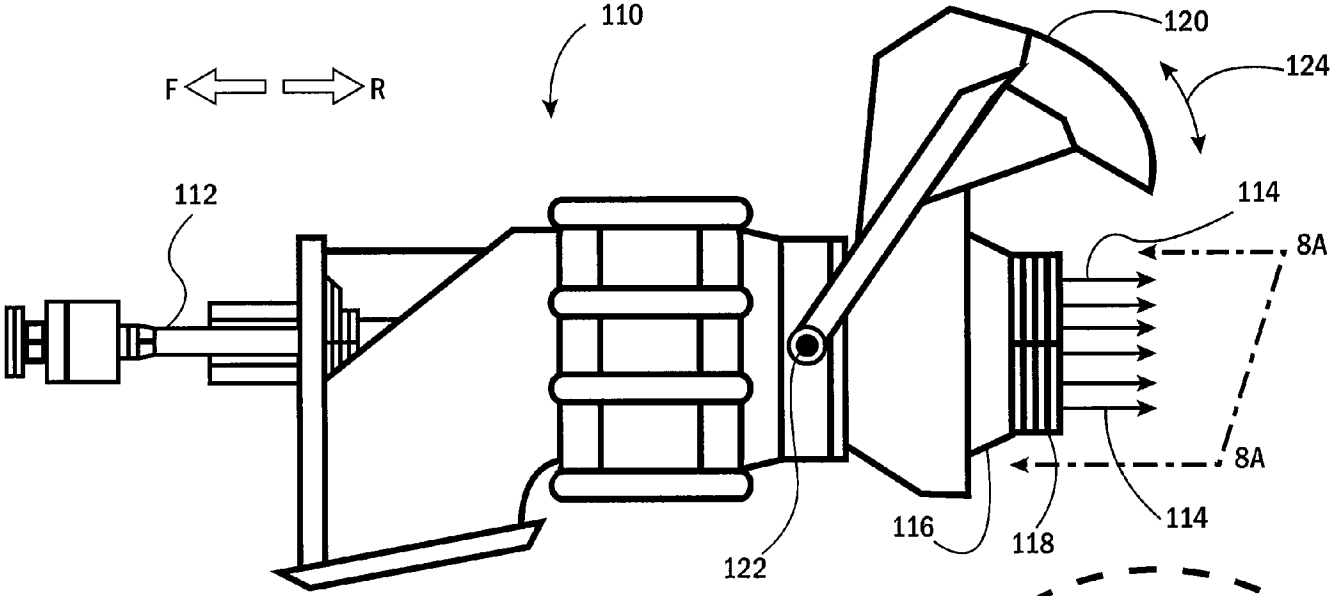
FIG. 8 is a single waterjet showing a reversing deflector.
Figure 8:
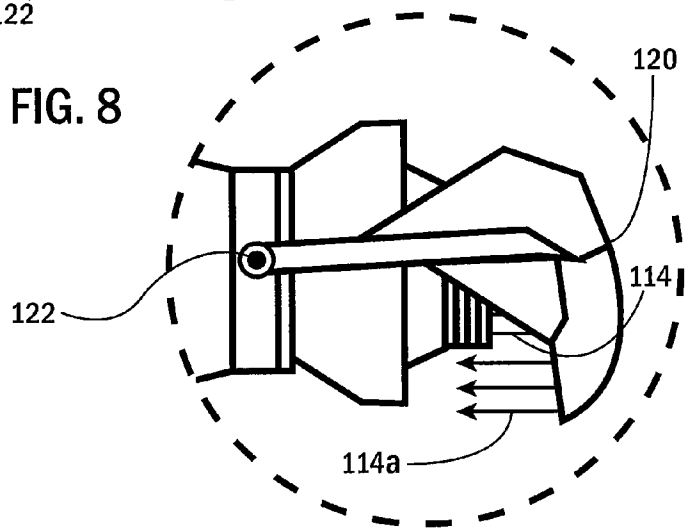
Figure 8A:
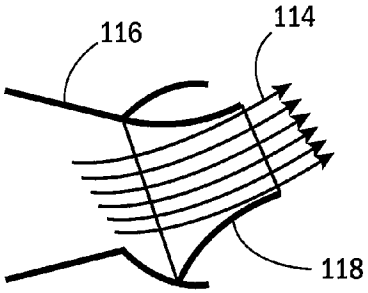
FIG. 8A is a cross section of the waterjet of FIG. 8 showing the steering deflector.

Turning now to FIG. 8 but also referring to FIGS. 8A and 7, a single waterjet is shown having mechanisms which control the direction of the watercraft in which it is mounted. An engagement apparatus such as shaft 112 rotates the impeller in the waterjet (not shown) resulting in a propulsive water flow 114 ejected from outlet nozzle 116. Outlet nozzle 116 is equipped with a steering deflector 118, which is best viewed in FIG. 8A (a top cross-section view taken along axis 8A). The steering deflector 118 is rotatably directed under control of steering system 87 (see FIG. 7). The deflection of the propulsive water flow 114 causes a corresponding turning of the marine vessel in response to the re-directed force of the water flow 118. For example, if the ejected water flow 114 is directed to starboard side as shown in FIG. 8A then the marine craft would be biased to rotatably turn in the same direction. Similarly, if the water flow 114 is directed to the port side then the marine craft would be biased to rotatably turn in the same direction (not shown).

Returning to FIG. 8, in addition, the waterjet 110 may also control the fore and aft movement of the marine vessel using reversing deflector 120. Reversing deflector 120 may be rotated about axis 122 resulting in movement of the deflector indicated by arrow 124. When the reversing deflector is retracted, as shown, the ejected water flow 114 is unimpeded and pushes the water craft in the forward direction indicated by arrow F. When the reversing deflector 120 is lowered such that it receives the ejected water flow 114, as shown in the inset in FIG. 8, the shape of the reversing deflector 120 redirects the water to produce water flow 114*a* so that it is flowing substantially in the direction of the arrow F thereby propelling the marine vehicle in the reverse direction indicated by the arrow R.

The water propulsion system according to the preferred embodiments comprises at least two waterjets as shown in FIGS. 1 and 2. The corresponding one or more steering deflectors 118 and the reversing deflectors 120 may be under control of the steering subsystem 87 with steering control 90 (as shown in FIG. 7). In addition there may be a reversing control (not shown).

Figure 9:
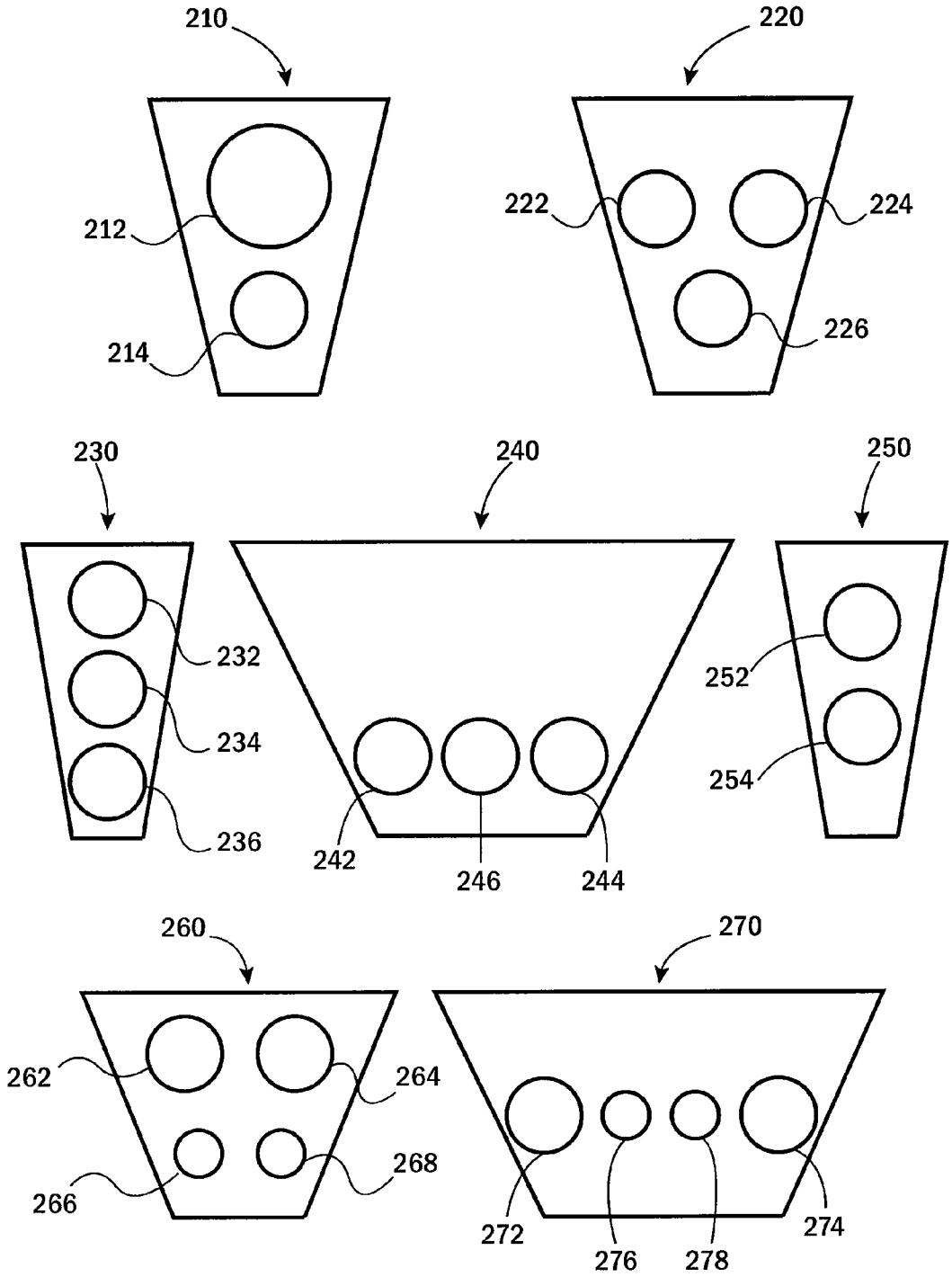
FIG. 9 is a plurality of outlet port configurations for various embodiments of the waterjet propulsion system in accordance with the preferred embodiments.

The water propulsion system according to the present invention may utilize multiple waterjets such as the waterjet 110 described in FIG. 8, however, with differing cross-sectional diameter relationships (i.e., differing relative outlet port diameters), and/or different combined (effective) diameters or effective port size area as shown in FIG. 9. The currently engaged waterjet configuration (i.e., the operational mode) allows the marine craft to operate with differing combinations of outlet port diameters in different operational modes. This flexibility allows optimum effective port area size for maximum efficiency for a given speed and water resistance whether the total area is just a single waterjet port or is a sum of two, three, or more different diameter ports. Thus, multiple differing diameters can be combined in different manners having different effective diameters (i.e., during different operational modes) thereby allowing for the versatility to achieve maximum efficiency at various speed and water resistance combinations.

FIG. 9 shows aft views of a boat transom with waterjet outlet ports of various configurations and diameters. A dual jet embodiment has a wider upper outlet port 212 which runs at a lower-speed and a narrower lower outlet port 214 that runs at a higher speed. A three jet embodiment 220 has dual upper outlet ports 222, 224 configured to act in tandem (providing a larger effective diameter) and a lower outlet port 226 which runs during a high-speed mode. Similarly, three jet embodiment 230 has a lower outlet port 226 and dual upper outlet ports 222, 224 (arranged vertically) configured to act in tandem (providing a larger effective diameter) The 3 outlet configuration allows the flexibility to have optimum port area or total diameter as well as also more freedom in mounting the waterjet outlet ports in a non conventional hull structure. The 3 outlet configuration more flexible as well, and is analogous to a three speed transmission (or more if you consider the differing combinations of engaged waterjets) as compared to the 2 outlet configuration which is analogous to a two speed transmission. As well, three jet embodiment 240 has dual outer outlet ports 242, 244 (arranged horizontally) configured to act in tandem (providing a larger effective diameter) and a central high-speed outlet port 246. A dual jet embodiment 250 may utilize both outlet ports 252, 254 in a low-speed operation mode and only the lower outlet port 254 in a high-speed mode. Multiple pairs of waterjets may be used, for example, in embodiment 260, upper outlet ports 262, 264 operate in tandem at a lower speed while lower and smaller outlet port 266, 268 operate in tandem at a high speed. Another embodiment 270 shows two pairs arranged horizontally and operating in tandem, outlet ports 272, 274 operate in tandem at lower speeds while outlet ports 276, 278 operate in tandem at higher speeds.

Other embodiments that are not show but contemplated may have an even or odd number of nozzles arranged vertically or horizontally (or some combination thereof) with important consideration given to balancing the propulsive power of the waterjets in various speed modes to avoid an unacceptable biasing movement that inadvertently turns the direction of the marine craft. For example, the placement of the waterjet outlets may be balanced with respect to the left and right halves of the marine craft to prevent unwanted left or right turning bias when any combination of waterjets is operational. In addition, the selection of the operational mode may be manually balanced based on operator's expertise, or could be automatically pre-selected depending on craft speed (after pre-establishing the change over points from actual testing of the craft or from resistance curves established by CFD or tank testing). Jets that are not otherwise engaged for forward propulsion in any given speed mode may be engaged to assist in turning the craft as well. In addition, the outlet ports may be rectangular in section or any of a variety of other shapes. In this case, a solution with three jets, two upper and one lower would have seven possible modes of operation.

Figure 10:
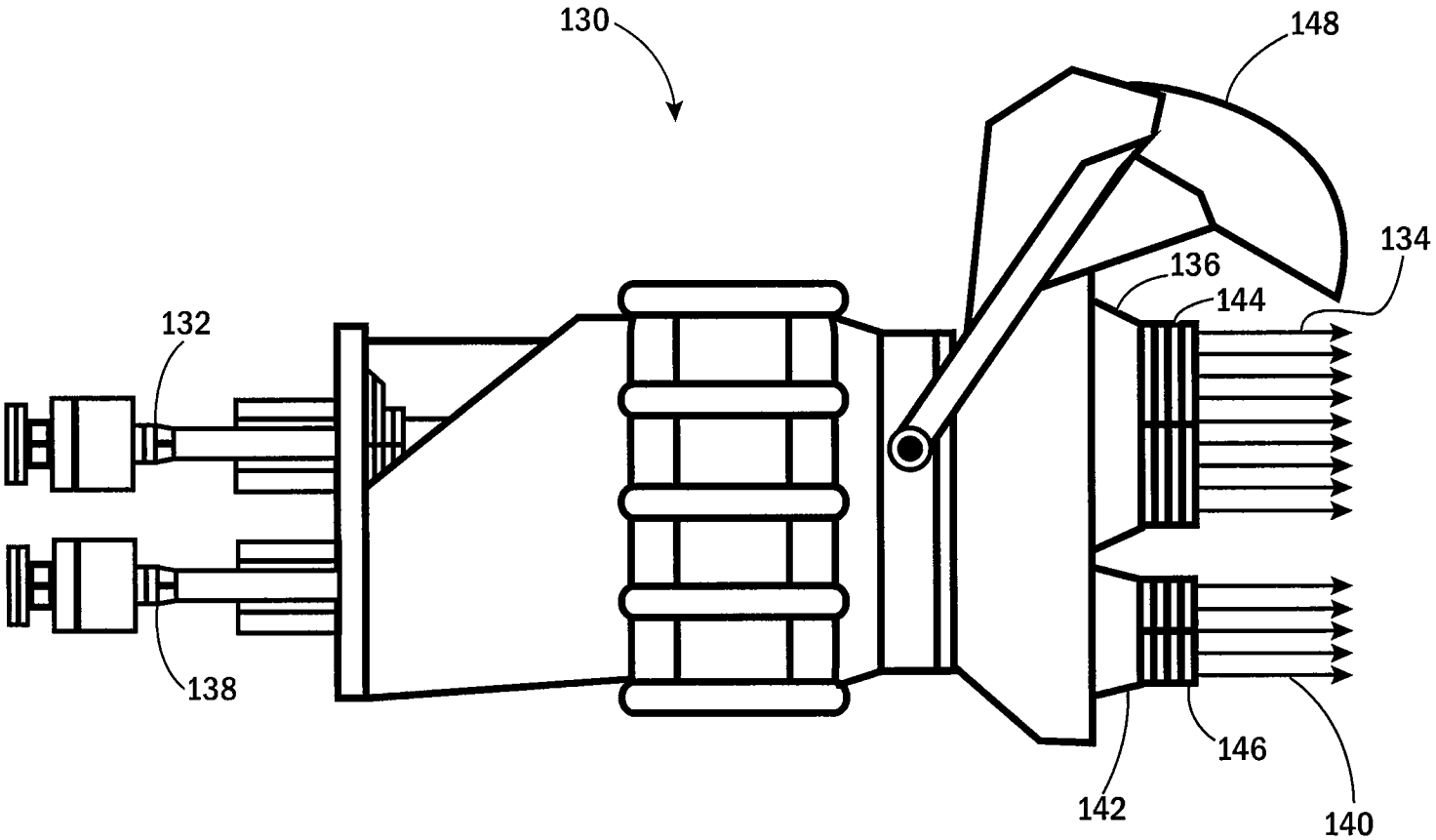
FIG. 10 is a waterjet propulsion system in accordance with a preferred embodiment, having dual power inputs and dual outlet ports in a single housing.

Turning now to FIG. 10, more than one waterjet may be integrated into a single unit 130. A first waterjet engagement apparatus such as shaft 132 rotates the impeller in the upper waterjet (not shown) resulting in a propulsive water flow 134 ejected from first outlet nozzle 136 and a second waterjet engagement apparatus such as shaft 138 rotates the impeller in the lower waterjet (not shown) resulting in a propulsive water flow 140 ejected from second smaller outlet nozzle 142. The upper outlet 136 may have corresponding upper steering deflector 144 and the lower outlet 142 may have corresponding steering deflector 146 (alternatively, one or neither of the outlets may have steering deflectors). In addition, the waterjet unit 130 may have a single reversing deflector 148. The single reversing deflector 148 may serve to redirect the water flow 134, 140 from both of the outlets 136, 142 when it is lowered into position (not shown). The steering deflectors 144, 146 and the reversing deflector 148 (collectively the steering mechanisms 87 of FIG. 7) may be under control of the steering subsystem 84 via steering wheel 90 as well as some other reversing control (not shown). Notably, the present assignee has proprietary technology that is able to implement alternative control methods for the steering and reverse control, allowing hull positioning of hulls using GPS. Assignee's unique joy stick positioning and control systems are able to be readily mated with the present preferred embodiments.

Figure 11:
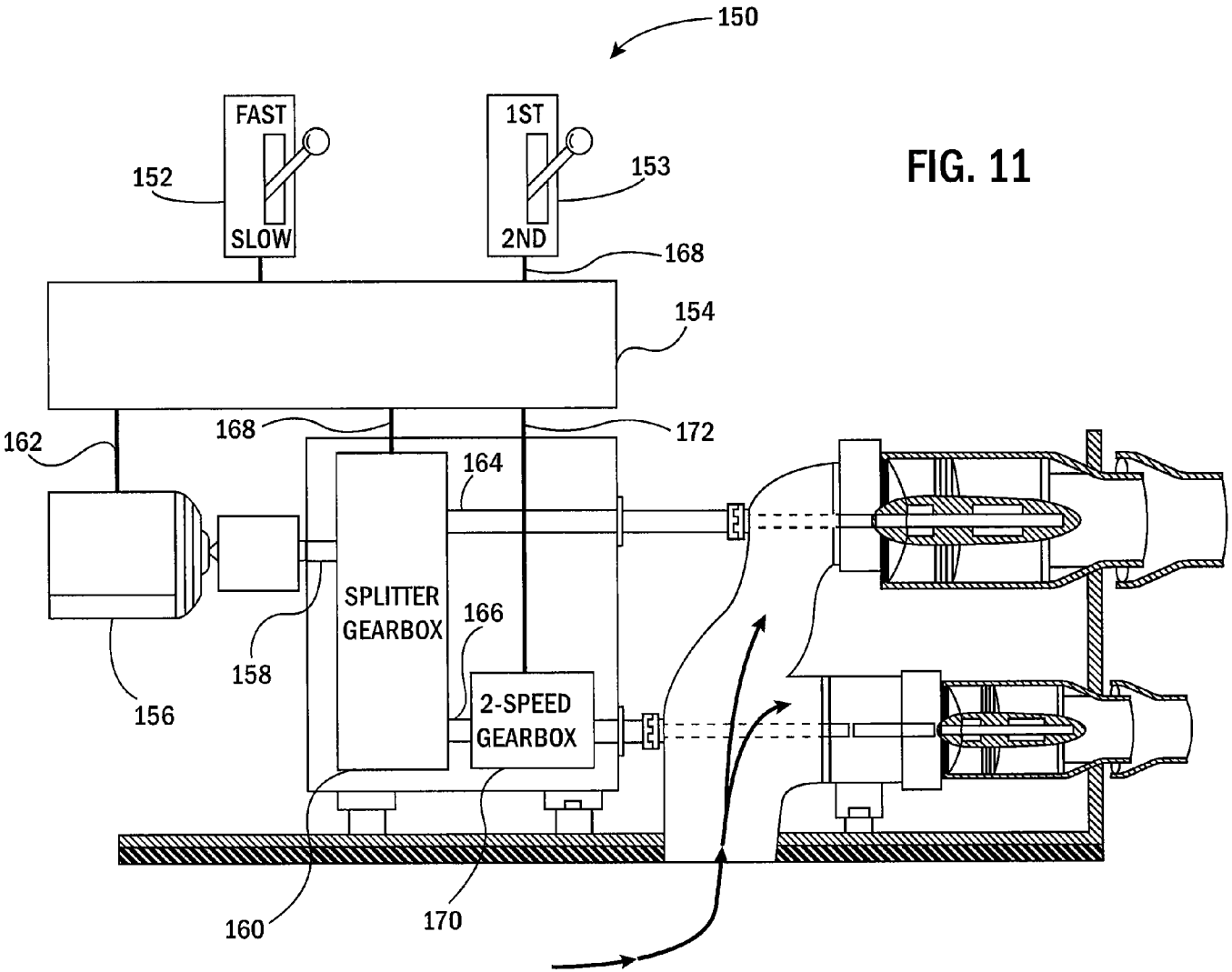
FIG. 11 is a side cross section view of the waterjet propulsion system showing a portion of the marine vehicle in cross section as well as the control system, splitter gearbox, and 2-speed gearbox.

Referring now to FIG. 11 a preferred embodiment of the waterjet propulsion system 150 according to the preferred embodiments is shown. The system 150 may include user controls for speed 152 and for gears 153. The user controls may be received by a control system 154 which may control the rate that the power source motor 156 rotates the shaft 158 into splitter gearbox 160 via some power supply connection 162 (for example a throttle to a fuel line for a combustion engine or an amount of electric current to an electric motor). The control system 154 may also control the independent engagement of splitter gearbox 160 with the waterjet engagement apparatuses 164, 166 via some connection such as 168. Finally, the control system may utilize a signal 168 from shift control 153 to control the state of the 2-speed gearbox 170 via some gearbox input 172. In another preferred embodiment, there may not be a manual shift control 153, but the control system 154 may shift the 2-speed gearbox according to one or more of the boat's speed (actual hull speed or user-selected speed), the boat's resistance, whether the boat is in high-speed or low-speed mode, and so forth. Two-speed gearbox 170 is preferably an MGX-series 2-speed transmission (QuickShift® transmission) or an MG-series 2-speed transmission, available from Twin Disc, Inc. headquartered in Racine, Wis. As well, the splitter box engagement and two-speed may be automatic (i.e. selectively engaging one or both waterjet propulsion units) based on marine craft speed (i.e., a throttle setting or actual hull speed) and/or marine craft resistance utilizing Twin Disc commercially available auto-trim control, for example. In addition automatically controlling the speed and operational mode of the craft may be enabled by determining water resistance (by tank tests, CFD, or actual testing of a waterborne vessel), which may allow pre-selected speed points for changing the outlet area (operational mode) and speed of the high speed jet(s).

In another embodiment the drive also includes a control such as 154 to selectively engage one or more of the waterjet propulsion units dependent upon one or more of a manual shift setting 153, a manual speed setting 152, as well as a marine craft actual direction, a commanded steering direction, and a commanded reversing direction (not shown).

Figure 12:
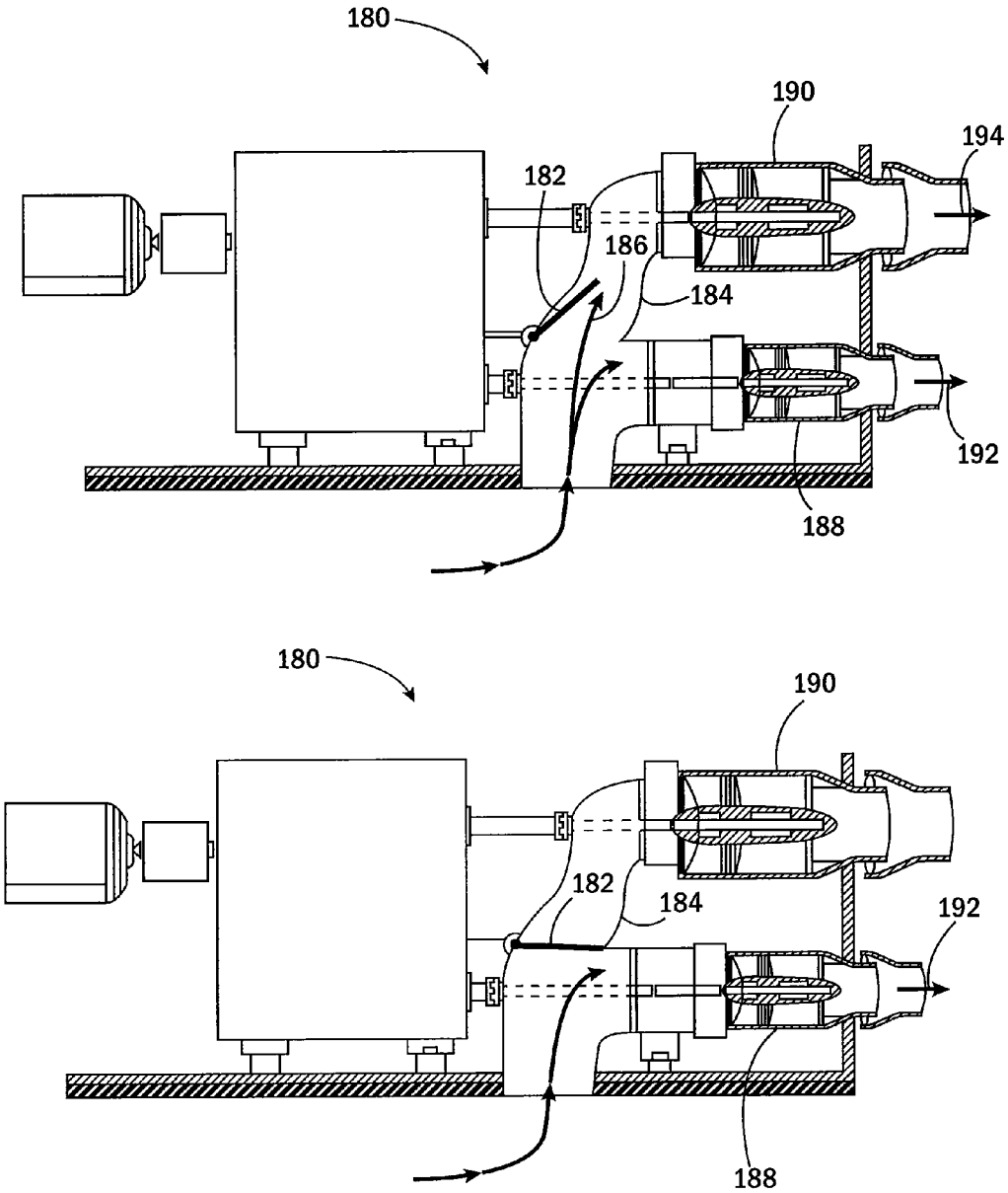
FIG. 12 is a side cross section view of the waterjet propulsion system showing diagrams of the upper inlet both open and closed.

Turning now to FIG. 12 an embodiment according to the present invention 180 is shown with a gate or flap 182 in the upper waterjet intake section 184. The flap 182 may be controlled so as to allow water 186 into the waterjet intake section 184 (as shown in the upper diagram), or it may be moved so as to prevent water from entering the waterjet intake section 184 (as shown in the lower diagram). Deployment of the flap 182 into the closed position, for example, can be done when the lower high-speed waterjet 188 is the only engaged waterjet such that the craft is being propelled by lower water flow 192. When the flap is in the open position, both waterjets 188, 190 may be engaged such that the craft is being propelled by both lower water flow 192 and upper water flow 194. Thus, control of the engagement of the waterjets may be synchronized with control of water intake with flap 182 to realize less internal drag and improved efficiency.

Figure 13:
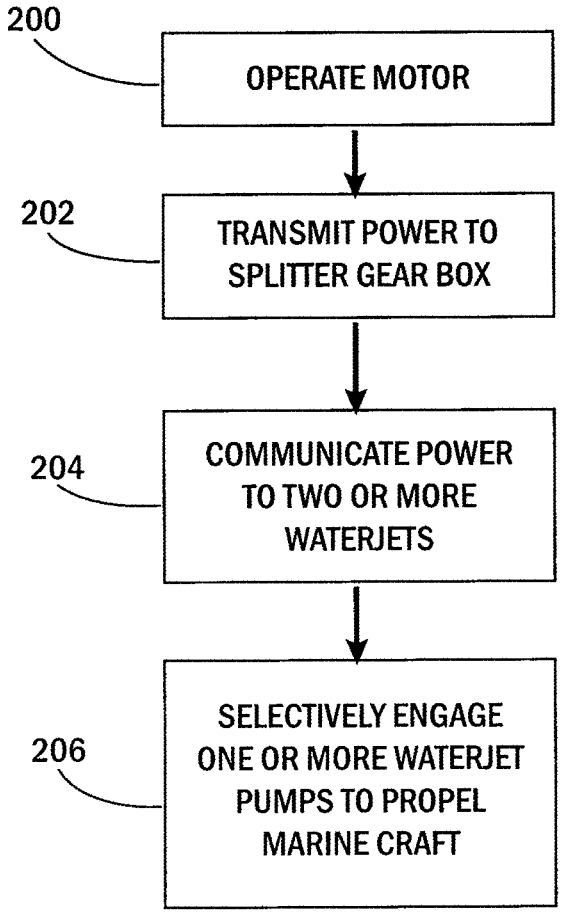
FIG. 13 is a block diagram of an embodiment of a method of waterjet propulsion in accordance with the preferred embodiments.

Referring now to FIG. 13, a method of waterjet propulsion for a marine craft is described having steps of 1) providing power from a power source 200, 2) transmitting power from the power source to at least one splitter gearbox 202, 3) communicating power from the splitter gearbox to two or more waterjet propulsion units (wherein the waterjet outlets for a given pair of waterjet propulsion unit outputs may be, for example, vertically arranged—i.e., "pairs" being defined as described herein, as upper waterjet(s) and lower waterjets, which may include one or more waterjets as described above, for instance, in connection with FIG. 9) 204, and 4) engaging one or more of the waterjet pumps to propel the marine craft 206. The pump sections, notably, may be engaged based upon the marine craft speed (actual or user-selected), water resistance, a selected gear, whether the craft is in high speed mode or a low speed mode, and so forth.

Figure 14:
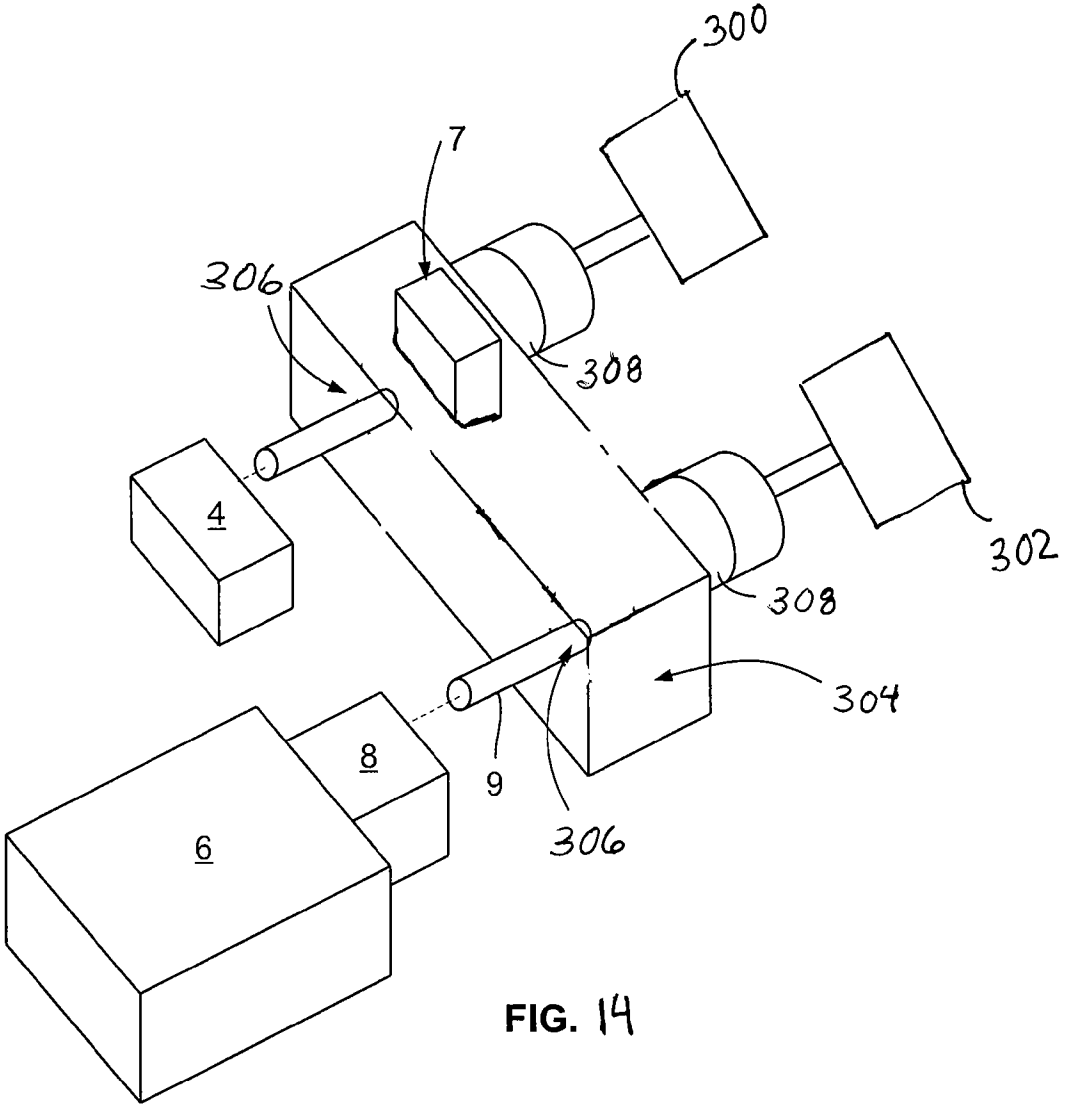
FIG. 14 is a schematic representation of a variant of the power splitting gearbox of FIG. 7, having multiple inputs and incorporating a secondary power source.

Referring to FIG. 14, splitter gearbox 88 provides an interface between the marine vessel 12 (FIG. 1) and the final drive assemblies 300, 302 while inputting power from a prime mover and dividing and distributing the power (or components thereof) to the final drive assemblies 300, 302 (waterjets, for example). In this regard, power splitting gearbox 88 allows a marine vessel with a single engine to drive a pair of drive assemblies 20, 22. Splitter gearbox 88, in one embodiment, may include a power splitting gearbox which includes a gearbox housing 304 that connects to the marine vessel 12 and at least partially encapsulates a gear train or other various components of the power splitting gearbox 88. The gearbox housing 304 may mechanically attach and provide an interfacing structure between the final drive assemblies 300, 302 and the transom 49 (FIG. 1).

Although the gearbox housing 304 components can be configured for mounting the power splitting gearbox 88 to the rearward facing or outboard surface of transom 49 and thus outside of marine vessel 12, it can instead be configured for mounting inside of the marine vessel 12. In other words, the power splitting gearbox 10 can attach to a forward facing or inboard surface of transom 49 by fixing the back wall to the front of transom 49 instead of fixing the front wall to the back of transom 49. In such inboard mounted configurations, the transom 49 is sandwiched between the power splitting gearbox 88 and the final drive assemblies 300, 302 with fasteners drawing the power splitting gearbox 88 and the final drive assemblies 300, 302 toward each other so that they clamp against opposing surfaces of the transom 49. Preferably the power splitting gearbox 88 is also attached to the transom 49 by fasteners provided at other mounting locations, such as about a perimeter of back wall, to supplement the clamping force established between the power splitting gearbox 88 and the final drive assemblies 300, 302 for holding them fixed with respect to the transom 49.

Regardless of whether the gearbox housing 304 is mounted, it preferably holds and protects a gear train therein. Since the gearbox housing 304 may be fixed with respect to the transom 49, gear train may also fixed with respect thereto, whereby the gear train retains its alignment or position with respect to the transom 49 at all times. Gear train mechanically splits power received through input 306 for delivery through multiple outputs 80 that are accessible through back wall and that drive the final drive assemblies 300, 302.

It is contemplated that input 306 and outputs the need not be separate and distinct components, apart from the gears, but rather can be integrated with individual ones of the gears. For example, input 306 can be a splined inner circumferential surface of one of the gears that receives a splined end of the transmission output shaft. Likewise, the outputs can be splined inner circumferential surfaces of ones of the gears that accept and drive splined ends of input shafts of the final drive assemblies 300, 302.

Referring again to FIG. 14, in some embodiments, the outputs are connected to clutches 308 that are interposed between the power splitting gearbox 88 and the final drive assemblies 300, 302. The clutches 308 allow an operator to selectively engage and/or disengage final drive assemblies 300, 302 individually or together, as desired. Furthermore, clutches 308 can be modulatable for controlling relative amounts of power that are transmitted from the outputs to respective final drive assemblies 300, 302.

FIG. 14 also shows an embodiment that includes multiple inputs 306. Such multiple inputs 306 can (i) provide multiple mounting and positioning options which can facilitate retrofitting applications, and (ii) can allow multiple prime movers to provide power to a single power splitting gearbox 10, individually or combined, depending on the particular desired end-use configuration. For example, in addition to a prime mover 6 (optionally coupled to a transmission 8, such as an MGX-series transmission (QuickShift® transmission) or an MG-series transmission, available from Twin Disc, Inc. headquartered in Racine, Wis.), a secondary power source 4 can be attached to the power splitting gearbox 88. In some embodiments, secondary power source 4 is an electric motor that can at times solely provide propulsive power for the marine vessel 12, without contribution from the prime mover 6. This configuration allows propulsion of the marine vessel 2 by electrical power only, as desired, for example, when trolling, when operating in a silent or stealth mode, when berthing or mooring, and/or if there is an operational failure of the prime mover 6.

Still referring to FIG. 14, the secondary power source 4 can be selectively coupled to one of the final drive assemblies 300, 302 and also to the gear train, allowing the secondary power source 4 to rotate only a single one of the output shafts. This can be accomplished in any of a variety of suitable ways. For example, a clutch assembly 7 can be provided between the gear train and final drive assembly 20, for engaging and disengaging them in driving communication with each other. Then, by coupling the secondary power source 4 to the final drive assembly 300, 302 the secondary power source 4 can provide power to the final drive assembly 300 when the clutch assembly 7 disengages the gear train from the final drive assembly 300.

Clutch assembly 7 is externally controlled, for example, by a control system for selecting which of the prime mover 6 and secondary power source 4 will be utilized at any given time, optionally by a stand-alone control system that controls only the clutch assembly 7. Regardless of the particular arrangements of such control systems, it is preferably configured so that a user's activation of the secondary power source 4 substantially simultaneously disengages the clutch assembly 7 and uncouples the gear train from the final drive assembly 20, while the secondary power source 4 operably couples therewith. Various suitable clutch assemblies 7 that allow multiple prime movers to be operably coupled to a single gearbox can be seen in the assignee's Provisional U.S. Patent Application Ser. No. 61/152,061, filed on Feb. 12, 2009, and entitled Hybrid Marine Power Train System, which is hereby incorporated by reference in its entirety.

If the electric motor of secondary power source 4 is also configured as a generator or gen-set, then the secondary power source 4 can stay operably connected to the final drive assembly 20 at all times. In such embodiments, when the prime mover 6 provides propulsive power, then the secondary power source 4 is driven by the prime mover 6 and through the gear train and/or final drive assembly 300, like an engine accessory, for generating electrical power that can be stored in batteries (not shown). Regardless of whether the secondary power source 4 is selectively or continuously coupled to the final drive assembly 300, an overall drive ratio defined between the secondary power source 4 and final drive assembly 300 can be a fixed ratio. Such fixed overall drive ratio is preferably selected to optimize the propulsion performance while using a single waterjet and a relatively less powerful prime mover, when compared to prime mover 6.

The waterjet propulsion systems according to the present invention need not be limited to the embodiments described above, but may include other embodiments. The scope of some of these changes is discussed above. The scope of others will become apparent from the appended claims.

Regardless, it is noted that many changes and modifications may be made to the present invention without departing from the spirit thereof. The scope of some of these changes is discussed above. The scope of others will become apparent from the appended statements of invention.

What is claimed is:

1. A drive for a marine craft comprising:
a power source;
a gearbox;
a plurality of waterjet propulsion units having a nozzle section, a cross-sectional diameter, and a waterjet engagement apparatus configured for transmitting power from the gearbox to the waterjet propulsion unit;
wherein at least one of the waterjet engagement apparatuses are engaged thereby providing propulsion to the marine craft;
wherein the plurality of waterjet propulsion units include a first waterjet propulsion unit having a first nozzle section having a first cross-sectional diameter, and a second waterjet propulsion unit having second nozzle section having a second cross-sectional diameter; and
wherein the waterjet engagement apparatus includes a first waterjet engagement apparatus configured for transmitting power from the gearbox to the first waterjet propulsion unit, and a second waterjet engagement apparatus configured for transmitting power from the gearbox to the second waterjet propulsion unit; and
wherein at least one of the first waterjet engagement apparatus and the second waterjet engagement apparatus is engaged thereby providing propulsion to the marine craft; and
wherein the drive further comprises one of:
A) a user operable control to selectively engage the first waterjet propulsion unit and/or to selectively engage the second waterjet propulsion unit;
B) an automatic control to selectively engage at least one of the first waterjet propulsion unit and the second waterjet propulsion unit dependent upon one or more of a marine craft speed and a marine craft resistance; and
C) an automatic control to selectively engage at least one of the first waterjet propulsion unit and the second waterjet propulsion unit dependent upon one or more of a marine craft actual direction, a commanded steering direction, and a commanded reversing direction.

2. The drive of claim 1 wherein a cross-sectional diameter relationship is one selected from a group comprising: 1) the first cross-sectional diameter is less than the second cross-sectional diameter, 2) the first cross-sectional diameter is substantially equal to the second cross-sectional diameter, and 3) the first cross-sectional diameter is greater than the second cross-sectional diameter.

3. The drive of claim 1 wherein the first waterjet propulsion unit comprises:
a first pump;
a first impeller in communication with the first waterjet engagement apparatus;
the first nozzle section having the first cross-sectional diameter; and
a first intake section;
and the second waterjet propulsion unit comprises:
a second pump;
a second impeller in communication with the first waterjet engagement apparatus;
the second nozzle section having the second cross-sectional diameter; and
a second intake section.

4. The drive of claim 3 wherein the first nozzle section is on a transom of the marine craft.

5. The drive of claim 3 wherein the second nozzle section is arranged substantially directly above the first nozzle section on the transom of the marine craft.

6. The drive of claim 3 further comprising at least one inlet port wherein the first intake section and the second intake section are in communication with the at least one inlet port.

7. The drive of claim 6 further comprising at least one gate configured for controlling a flow of water into at least one of the first intake section and the second intake section.

8. The drive of claim 1 further comprising a transmission element connected to the power source configured for transmitting power to the gearbox wherein the transmission element further comprises a 2-speed gearbox.

9. The drive of claim 1 wherein the first waterjet engagement apparatus further comprises a 2-speed gearbox.

10. The drive of claim 1 further comprising a steering deflector configured to steer the marine craft by deflecting a water flow ejected from the first nozzle section and a second water flow ejected from the second nozzle section.

11. The drive of claim 1 further comprising at least one reversing deflector configured to reverse the marine craft by deflecting at least one of a group including a water flow ejected from the first nozzle section and a second water flow ejected from the second nozzle section.

12. The drive of claim 1 further comprising a first steering deflector configured to steer the marine craft by deflecting a water flow ejected from the first nozzle section and a second steering deflector configured to steer the marine craft by deflecting a second water flow ejected from the second nozzle section.

13. A drive comprising:
a marine craft;
a power source;
one or more splitter gearboxes;
one or more transmission elements connected to the power source configured for transmitting power to the one or more splitter gearboxes;
one or more pairs of waterjet propulsion units wherein each pair comprises a first waterjet propulsion unit and a second waterjet propulsion unit wherein each waterjet is selectively engagable;
the first waterjet propulsion unit comprising:
a first pump section;
a first waterjet engagement apparatus configured for transmitting power from at least one of the splitter gearboxes to the first waterjet propulsion unit;
a first impeller in communication with the first waterjet engagement apparatus;
a first nozzle section having a first cross-sectional diameter; and
a first intake section; and
the second waterjet propulsion unit comprising:
a second pump section;
a second waterjet engagement apparatus configured for transmitting power from at least one of the splitter gearboxes to the first waterjet propulsion unit;

a second impeller in communication with the first waterjet engagement apparatus;

a second nozzle section having a first cross-sectional diameter; and a second intake section.

14. The drive of claim 13 wherein the cross-sectional diameter relationship is one selected from a group comprising: 1) the first cross-sectional diameter is less than the second cross-sectional diameter, 2) the first cross-sectional diameter is substantially equal to the second cross-sectional diameter, and 3) the first cross-sectional diameter is greater than the second cross-sectional diameter.

15. A method of driving a marine craft comprising steps of:

providing power from a power source;

transmitting power from the power source to at least one splitter gearbox;

communicating power from at least one splitter gearbox to two or more waterjet propulsion units wherein the waterjet outlets for a given pair of waterjet propulsion units are vertically arranged;

selectively engaging one or more selected pump sections of the waterjet propulsion units so as to provide propulsive force from water exiting at least one waterjet propulsion unit nozzle outlet sections so as to drive the marine craft; and wherein the one or more selected pump sections are engaged based upon one or more of a marine craft speed, a marine craft resistance, a user selected speed, a user selected gear, a speed higher than a predetermined threshold mode, a speed lower than a second predetermined threshold mode, and one or more nozzle outlet section configurations.

16. The method of claim 15 further comprising selectively engaging one or more of the waterjet propulsion units dependent upon one or more of a manual shift setting, a manual speed setting, a marine craft actual direction, a commanded steering direction, and a commanded reversing direction.

* * * * *